US009125504B2

(12) United States Patent
Baaijens et al.

(10) Patent No.: US 9,125,504 B2
(45) Date of Patent: Sep. 8, 2015

(54) METHOD AND SYSTEM FOR EMPHASIZING OBJECT COLOR

(75) Inventors: Johannes Petrus Wilhelmus Baaijens, Eindhoven (NL); Petrus Johannes Mathijs Van Der Burgt, Valkenswaard (NL); Simone Helena Maria Poort, Veldhoven (NL); Christopher Paul Schutte, Milan (IT)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 522 days.

(21) Appl. No.: 13/574,628

(22) PCT Filed: Jan. 25, 2011

(86) PCT No.: PCT/IB2011/050322

§ 371 (c)(1), (2), (4) Date: Jul. 23, 2012

(87) PCT Pub. No.: WO2011/092625

PCT Pub. Date: Aug. 4, 2011

(65) Prior Publication Data

US 2012/0280624 A1 Nov. 8, 2012

(30) Foreign Application Priority Data

Jan. 28, 2010 (EP) ..... 10151869

(51) Int. Cl.

*H05B 37/02* (2006.01)
*A47F 11/10* (2006.01)
*H05B 33/08* (2006.01)

(52) U.S. Cl.

CPC ..... *A47F 11/10* (2013.01); *H05B 33/0863* (2013.01); *H05B 33/0869* (2013.01); *H05B 33/0872* (2013.01)

(58) Field of Classification Search

USPC ..... 315/149

See application file for complete search history.

(56) References Cited

U.S. PATENT DOCUMENTS 5,129,726 A 7/1992 Nielsen
5,521,708 A * 5/1996 Beretta ..... 356/402

(Continued)

FOREIGN PATENT DOCUMENTS

JP 2008071662 A 3/2008
JP 2008522358 A 6/2008

(Continued)

OTHER PUBLICATIONS

Mang Ou-Yang; "Optimize Maximal Brightness and Correlated Color Temperature for Multi-Primary Color Displays", Applications of Digital Image Processing XXXII, Proc. of SPIE, vol. 7443, 2009.

(Continued)

*Primary Examiner* — Ryan Jager
(74) *Attorney, Agent, or Firm* — Meenakshy Chakravorty

(57) ABSTRACT

A method for controlling a color adjustable light source (101) configured to illuminate an object (110) is disclosed. The method comprises the steps of setting (301) a color temperature of a reference white point (cpref) at the black body curve (202), acquiring (302) information as to a color of the object (cpobj), receiving (303) a desired saturation level, and controlling (304) the light source (101) to illuminate the object (110) with light corresponding to the color temperature of the reference white point and comprising a saturated component corresponding to the color of the object. A corresponding system (100) for performing the method is also disclosed.

15 Claims, 4 Drawing Sheets

(56) References Cited

U.S. PATENT DOCUMENTS

| | | | | |
|---|---|---|---|---|
| 5,790,329 | A | 8/1998 | Klaus | |
| 6,175,693 | B1 | 1/2001 | Iida | |
| 6,674,530 | B2 | 1/2004 | Berstis | |
| 7,019,789 | B2 | 3/2006 | Kang et al. | |
| 7,248,239 | B2 | 7/2007 | Dowling et al. | |
| 8,189,008 | B2 * | 5/2012 | Julio | 345/581 |
| 8,427,721 | B2 * | 4/2013 | Vinkenvleugel et al. | 358/520 |
| 8,933,903 | B2 * | 1/2015 | Baaijens et al. | 345/173 |
| 2008/0012722 | A1 * | 1/2008 | Moseley | 340/825.69 |
| 2008/0136356 | A1 | 6/2008 | Sampini et al. | |
| 2008/0170387 | A1 | 7/2008 | Fluss et al. | |
| 2008/0180670 | A1 | 7/2008 | Vogel | |
| 2008/0258590 | A1 * | 10/2008 | Van De Sluis et al. | 312/237 |
| 2008/0259590 | A1 * | 10/2008 | De Goederen-Oei | 362/85 |
| 2009/0051532 | A1 | 2/2009 | Van Der Poel | |
| 2009/0168415 | A1 * | 7/2009 | Franciscus Deurenberg et al. | 362/233 |
| 2010/0127282 | A1 | 5/2010 | Harbers et al. | |
| 2010/0213876 | A1 * | 8/2010 | Adamson et al. | 315/312 |

FOREIGN PATENT DOCUMENTS

| | | | |
|---|---|---|---|
| JP | 2008264430 | A1 | 11/2008 |
| JP | 2008270089 | A1 | 11/2008 |
| JP | 2009099510 | A | 5/2009 |
| WO | 2006114725 | A1 | 11/2006 |
| WO | WO 2006114725 | A1 * | 11/2006 |

OTHER PUBLICATIONS

Nan Zhao; "Smart Solid-State—State Lighting Control", sTEUERUNG Eines Intelligenten, bELICHTUNGSSYSTEMS MIT LED, Lichtquellen, Nan Zhao, Betreuer/-in: Joe Paradiso, Steffen Leohardt, Aug. 26, 2010.

"Guide to Light and color in Retail Merchandising" Lighting Research Center, Alliance for Solid-State Illumination Systems and Technologies, vol. 8, Issue 1, Mar. 2010, pp. 1-16.

Konica Minolta, "Precise Color Communication", http:konicaminolta.com/instruments/about/network.

Nan Zhao, "Smart Solid State Lighting Control", Steuerung eines Intelligenten Belichtungssystems mit LED Lichtquellen,Betreuer/-in: Joe Paradiso, Steffen Leonhardt, Aug. 26, 2010.

* cited by examiner

METHOD AND SYSTEM FOR EMPHASIZING OBJECT COLOR

TECHNICAL FIELD

The present invention relates to a method for controlling a color adjustable light source used for illuminating an object. The present invention also relates to a corresponding system.

BACKGROUND OF THE INVENTION

Recently, color adjustable light sources such as light emitting diodes combining red, green and blue light to achieve for example white light are increasingly used in for example households and in commercial settings. The control of such light sources has conventionally been performed by technicians having certain skills and experience, since control of brightness, color and saturation parameters is relatively complicated and conventionally requires certain knowledge and skills.

As the use of color adjustable light sources has increased, the demand of intuitive control of such light sources has also increased among other users than experts. For facilitating color control of light sources such as LEDs with a combined color output of red, green, and blue, US20080259590 disclose a user interface with control of for example hue, color and saturation of light. The user interface comprises a central button for changing the color, a saturation button, a hue button, and may be a remote control.

Concerning illuminating light sources, such as LED-based RGB spotlights that may be used to illuminate objects in a store, a museum or the like, it is important that the illuminating light is controlled in a way that enhances the appearance of the object for the viewer. For example in stores, it may be desired to emphasize a certain color of a product or a product display to make the product more visible and more attractive to a viewer. Although providing an improved more intuitive user interface for controlling the color output of a light source in US20080259590, obtaining an illumination that highlights a color of an object would still be relatively complicated. In an attempt to highlight a color of an object using the solution described in US20080259590, several parameters that affect each other would have to be adjusted, most likely requiring several attempts of adjusting each parameter, why optimal illumination of an object may become very troublesome or even impossible to achieve by a non-experienced user.

Hence, there is a need for an improved method of controlling a color adjustable light source for highlighting a color of an illuminated object.

SUMMARY OF THE INVENTION

According to an aspect of the invention, the above is at least partly met by a method for controlling a color adjustable light source configured to illuminate an object, comprising the steps of setting a color temperature of a reference white point adjacent to the black body curve, acquiring information as to a (e.g. dominant) color of the object, receiving a desired saturation level, and controlling the light source to illuminate the object with light corresponding to the color temperature of the reference white point and comprising a saturated component corresponding to the color of the object.

By black body curve should be understood the black body curve in CIE1931 x, y space, extending between different color temperatures of white light as is well known to the skilled person. Also, by a white point adjacent to the black body curve may mean a point exactly at the black body curve, or at least in the area where the light is still considered as white light. By a color adjustable light source may mean any light source that may be adjustable in color space, such as a RGB spot or an RGBW (RGB+white) or RGBA (RGB+amber) spot. Setting of a color temperature of a reference white point adjacent to the black body curve may mean any color point adjacent to the black body curve, or the setting may be restricted to for example a cooler color temperature or a warmer color temperature, to only a selection of different warm color temperatures, etc. It should be noted that within the context of the application the term object may be any type of physical object also including surfaces such as walls, ceilings, floors or other types of surfaces.

The present invention is based on the realization that if the color of the object, such as the dominant color or another selected color, to be illuminated is known, this particular color can be specifically emphasized by means of adding a saturation component of this color to the illuminating light. More specifically, the present inventors have realized that when knowing the color of the object or objects to be illuminated, and by that what color to emphasize, the illuminating light may be controlled to illuminate the object with light corresponding to a desired color temperature of white reference light which is set to the black body curve but with addition of a saturation component of the color of the object. By adding the saturation component, the color of the object may be highlighted and the object may accordingly be perceived as more visible to a viewer. Such control may be performed by using the CIE1931 x, y color space diagram, wherein the color gamut boundaries for the illuminating light source may be drawn. All available saturation levels for the light source in question may be found along a straight line in CIE1931 x, y color space, which line starts at 0% saturation at the set reference white point on the black body curve, continues through the measured color point, and ends up at full saturation at the color point that is located on the boundary of the color gamut of the illuminating light source. Additionally, a straight line corresponding to color points of constant color temperature can be drawn in CIE color space. Lines of constant color temperature in the CIE color space are known as isotherms. Thus, an isotherm intersecting the reference white point defines color points having the same color temperature as the reference white point. Hence, controlling a color adjustable light source may be performed in a few execution steps by applying knowledge of the color of the object to be illuminated to the method of controlling, thereby being able to merely focus on a desired saturation level of that particular color.

Acquiring information as to the color of the object also includes the possibility to acquire a rough color classification of the object such as for example a color selected from the group comprising red, orange, yellow, green, cyan, blue, violet, purple and magenta. Accordingly, it should be noted that the invention is not limited to applying a saturation level exactly on a line that intersects both the reference white point on the black body curve and the acquired color of the object (e.g. the roughly estimated color). Thus, this rough estimate also applies to the saturation level. More specifically, the wording "comprising a saturated component corresponding to the color of the object" should be understood to have a broad meaning including that the line with varying saturation for example in one case may be exactly directed to the measured object color, or may in another case be approximately directed to the measured object color (along an isotherm that is not exactly directed at the measured object color).

In one embodiment of the invention, the spectral power distribution of the color adjustable light source may advantageously be controlled for a given reference white point, object color and saturation level. The spectral distribution of the illuminating light may be changed such that certain parts of the spectrum have stronger contribution while maintaining constant color temperature. As an example, a color mixing light source such as a RGBW light source may create each color point in multiple ways, thereby making it possible to choose the spectral power distribution that for a specific object color provides the highest emphasis of that specific color. Hence, the color rendering properties can be different for each of the RGBW combination for the same color point. Other color mixing light sources such as RGBA, RGBAC (RGBA+Cyan) and the like may equally well be used.

Further, the step of acquiring information as to a color of the object may comprise the steps of illuminating the object with light having the color temperature of the reference white point, such that the color of the object is reflected; and measuring the color of the object by means of a color sensor. The object color may advantageously be measured for achieving an optimal color emphasizing illumination. By that means, each object of for example a museum or a store may be illuminated in a color intensifying manner which is optimal for that particular object. In addition, the color sensor may be directed to the part of the object that a user desires to highlight, which does not necessarily is the dominant color of the object. Further, the saturation level may be set by a user, via for example a user interface.

Alternatively, the step of acquiring information as to a color of the object may comprise the steps of reading an object identification code for the object; and retrieving a color corresponding to the object identification code. The identification code may be any readable identification code, such as for example a bar code or an RFID code. In many applications it may be advantageous if the information of what color to be emphasized when illuminating the object is contained in an identification code of the object, the object color being retrieved from a table or database, stored in the system or found from a centrally stored database via a mobile phone or via an internet link. In this way, in for example chain stores where the same products are displayed in all stores, the products may also be illuminated in the same way in all stores, since the dominant color or the color to be highlighted may be easily acquired without the need of performing measurements at each site.

Furthermore, the step of receiving a desired saturation level may comprise the step of retrieving a pre-stored saturation level corresponding to the object identification code, whereby a saturation level may be automatically set when the object identification code is known, without manual selection. The automatic control may be desired if illuminating the same type of objects frequently, or when minimum manual control is desired. Also, automatic saturation level setting may be advantageous in chains of stores, etc. so that the same type of products is illuminated with the same level of saturation everywhere. The saturation level may for example be stored in a table in relation to a certain object identification code. Alternatively, as already mentioned, the saturation level may be set by a user selection.

Moreover, the saturation level may be limited to a predefined area surrounding the black body curve, i.e. defined by boarder lines above and below the black body curve, respectively. In the CIE1931 x, y color space the available color points for the light source are located on the straight line between the reference white point on the black body curve and the boundary of the color gamut of the adjustable light source, which line passes through the acquired color point of the object. Alternatively, the available saturation levels may be restricted to a few levels on this line, such as saturation levels where the light source remains emitting light within the range of what is considered as white light, which is an area surrounding the black body curve.

According to another aspect of the invention, there is provided a system for controlling a color adjustable light source comprising a light source configured to illuminate an object, and a control unit configured to set a color temperature of a reference white point adjacent to the black body curve, acquire information as to a color of the object, receive a desired saturation level, and control the light source to illuminate the object with light corresponding to the color temperature of the reference white point and comprising a saturated component corresponding to the color of the object. The light source illuminating the object may be any color adjustable light source that is regularly illuminating an object to make it more visible to a user. By controlling the light source using a system according to the invention the control of illuminating an object to emphasize a certain color may be facilitated, and the quality of illumination improved.

The control unit may for example acquire the color temperature of the reference white point via a user interface or by using a predetermined setting. Also the saturation component may be achieved via a user interface or by other methods as will become clear hereinafter.

Further, the system may comprise a reference light source configured to illuminate the object with light having the color temperature of the reference white point, such that the color of the object is reflected; and a color sensor configured to measure the color of the object. By using a color sensor the acquiring of the color of the object may be made simplified, by simply keeping the color sensor at a distance from the object to measure and measure the reflected color.

According to one embodiment of the invention, the system may optionally comprise an ambient light sensor arranged in proximity of the illuminated object and configured to measure the ambient light, the ambient light sensor being communicatively coupled to the control unit. By measuring the color and color temperature of ambient light it becomes possible to adjust the illumination of an object also taking into account the properties of ambient light, thereby improving the color emphasizing effect. The ambient light may be white light of different color temperatures from various lighting systems, colored light or outdoor (e.g. sun) light which may vary with weather and time of day.

Alternatively, the light source illuminating the object may be the reference light source, whereby an additional light source for illuminating with the color temperature of the reference white point may be omitted.

Moreover, the system may further comprise a remote control on which the reference light source and the color sensor may be arranged, which may simplify the measuring of the object color, since a remote control may easily be held in front of the object on a sufficient distance from the object.

Alternatively, the color sensor may be stationary, and for example arranged in the vicinity of the illuminating light source, where the illuminating light source further is configured as the reference light source.

Further, the system may comprise a code reader configured to read an object identification code for the object, and retrieve the color corresponding to the object identification code, which is advantageous in the case the object color and/or the saturation level may be retrieved from a product identification code. For example, the code reader may be an RFID reader or a bar code reader. Moreover, the system may comprise a remote control comprising the code reader, for facilitating reading of the identification code.

Further features of, and advantages with, the present invention will become apparent when studying the appended claims and the following description. The skilled person realize that different features of the present invention may be combined to create embodiments other than those described in the following, without departing from the scope of the present invention.

BRIEF DESCRIPTION OF THE DRAWINGS

The various aspects of the invention, including its particular features and advantages, will be readily understood from the following detailed description and the accompanying drawings, in which.

DETAILED DESCRIPTION

Figure 1:
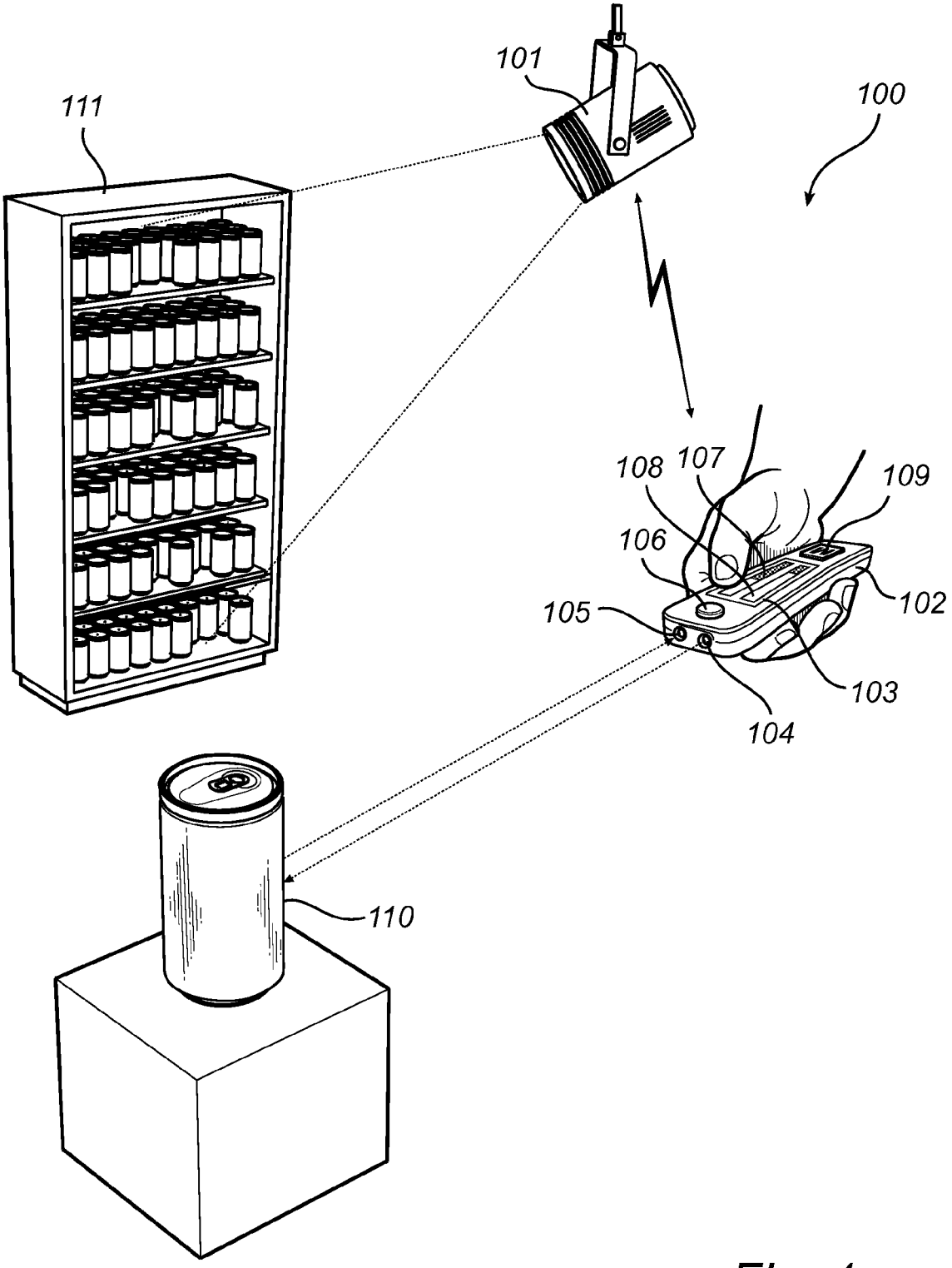
FIG. 1 illustrates a system according to an embodiment of the present invention.

The present invention will now be described more fully hereinafter with reference to the accompanying drawings, in which currently preferred embodiments of the invention are shown. This invention may, however, be embodied in many different forms and should not be construed as limited to the embodiments set forth herein; rather, these embodiments are provided for thoroughness and completeness, and fully convey the scope of the invention to the skilled person. Like reference characters refer to like elements throughout.

In FIG. 1 there is depicted an exemplifying lighting system 100 comprising an illuminating light source 101, a remote control 102, which in its turn comprises a user interface 103, a reference light source 104, and a color sensor 105. Further, the light source 101 is color adjustable, here an RGB spot, and illuminates for example a display of cans 111 which may be found in a store. Here a single can 110 is also illustrated. Alternatively, the illuminating light source 101 is also the reference light source 104. The user interface 3 here comprises a control, in the illustrated example a rotatable knob 106, via which a color temperature of a reference white light is set. Further, the user interface comprises a slider 107 for setting a desired saturation level of the object color to be emphasized, and another slider 108 for setting a brightness level. Moreover, the user interface comprises an actuating key 109 which is pressed when initiating a color measurement by means of the system 100. The remote control 102 may moreover comprise a distance sensor (not shown) that is used to inform the user if the color sensor 105 is too far away from the object to be able to measure the object color. The lighting system 100 also comprises a control unit (not shown) in communication with the remote control and the illuminating light source. The control unit may include a microprocessor, microcontroller, programmable digital signal processor or another programmable device. The control unit may also, or instead, include an application specific integrated circuit, a programmable gate array or programmable array logic, a programmable logic device, or a digital signal processor. Where the control unit includes a programmable device such as the microprocessor, microcontroller or programmable digital signal processor mentioned above, the processor may further include computer executable code that controls operation of the programmable device.

Optionally, the lighting system 100 may also comprise a sensor (not shown) for measuring the ambient (e.g. white) light. When there is ambient light in a space where the lighting system 100 is used, the light on the object is a combination of the ambient light and the emphasizing light used for creating the color emphasis effect. Increasing the intensity of the ambient white light may result in a decrease of the level of color emphasis. Likewise, the color emphasis may increase if the intensity of ambient white light is decreased. Furthermore, the color temperature of ambient light may change. As an example, the color temperature of daylight may be different depending on weather and time of day.

By measuring the color and color temperature of ambient light it is possible to adjust the light source 101 to compensate for changes in ambient light, thereby maintaining a constant color emphasis effect for the illuminated object. This may be achieved by arranging a light sensor adjacently or near the illuminated object that measures the ambient light, and that uses a feedback or feed-forward control method to adjust the illuminating light source. To be able to measure the ambient light in an area where both the color emphasis lighting and ambient light is present, the sensor may be connected to the color adjustable light source 101, and during short time intervals, sufficiently short to be unperceivable to human observers, the adjustable light source 101 is turned off or dimmed to near zero level that the ambient light can be measured.

Figure 2:
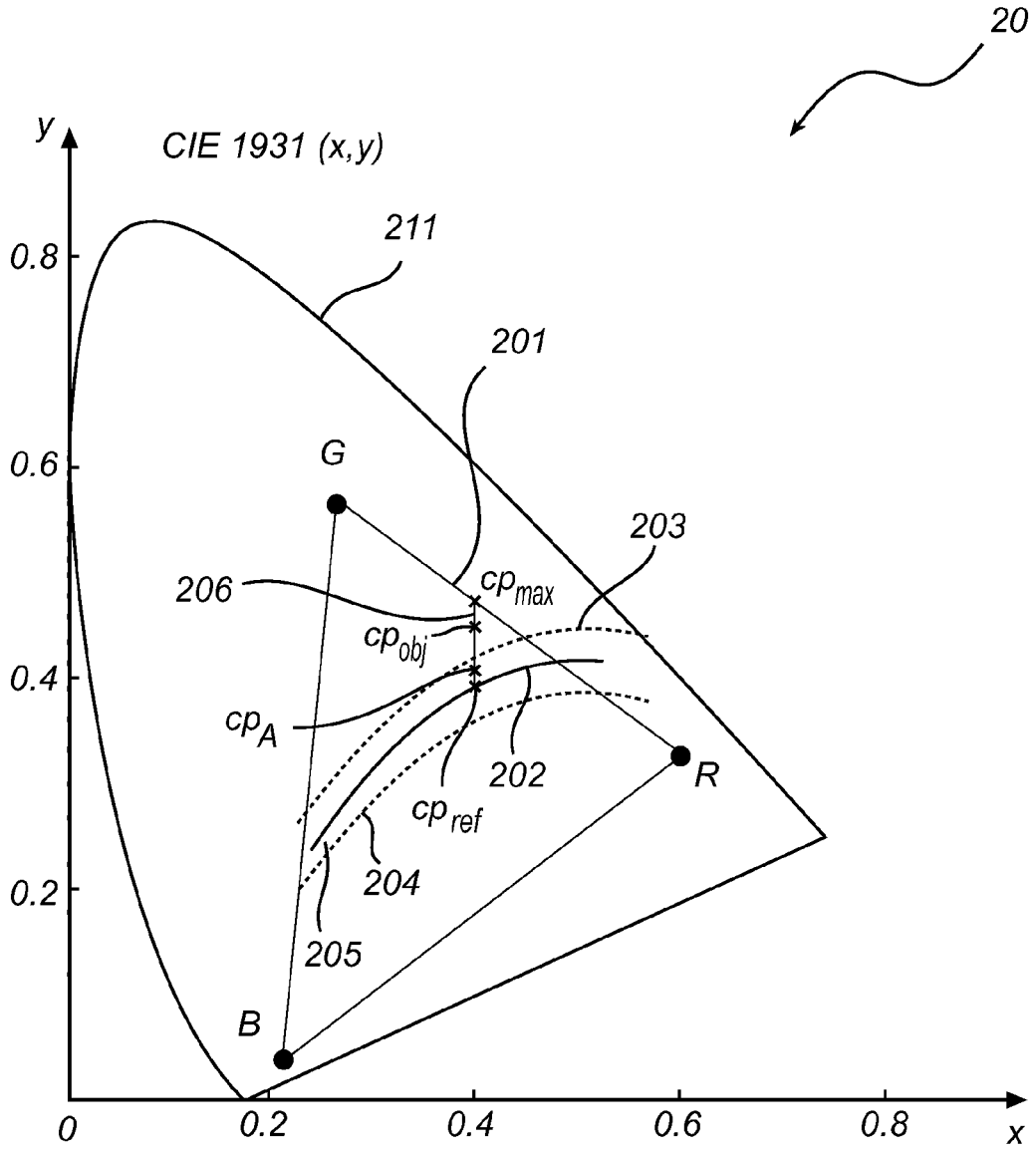
FIG. 2 shows a color space chromaticity diagram.

Before describing the method of the present invention performed by the system 100, the CIE1931 x, y color space diagram 20 illustrated in FIG. 2 is introduced.

In FIG. 2 the outer horseshoe-shaped curve 211 corresponds to the colors of the visible spectrum (color points of monochromatic light). The color gamut boundaries of the RGB spot 101 is depicted as a triangle 201 which triangle encloses all color points that the RGB spot 101 is able to emit. In other words, the color of the RGB spot is adjustable between each color point within the depicted triangle 201. Further, there is depicted a black body curve 202 extending through the color space, for different color temperatures of white light. At the black body curve the color saturation is 0%. The saturation level at the boundary triangle 201 is 100%.

There is also depicted an upper 203 and a lower 204 curve, illustrated with dashed lines, enclosing the black body curve 202. The upper 203 and lower 204 curves are enclosing an area 205 within the boundary triangle 201 within which area 205 the emitted light is considered as white light although having a color saturation level of more than 0% of another color. The area 205 may for example be defined by the formula $$y=2.3653x-2.3172x^2-0.2199$$

for the lower curve 204, and $$y=2.3653x-2.3172x^2-0.1595$$

for the upper curve 203, where x=0.23 . . . 0.57. Other definitions of the area may of course be possible and are within the scope of the invention.

Figure 3:
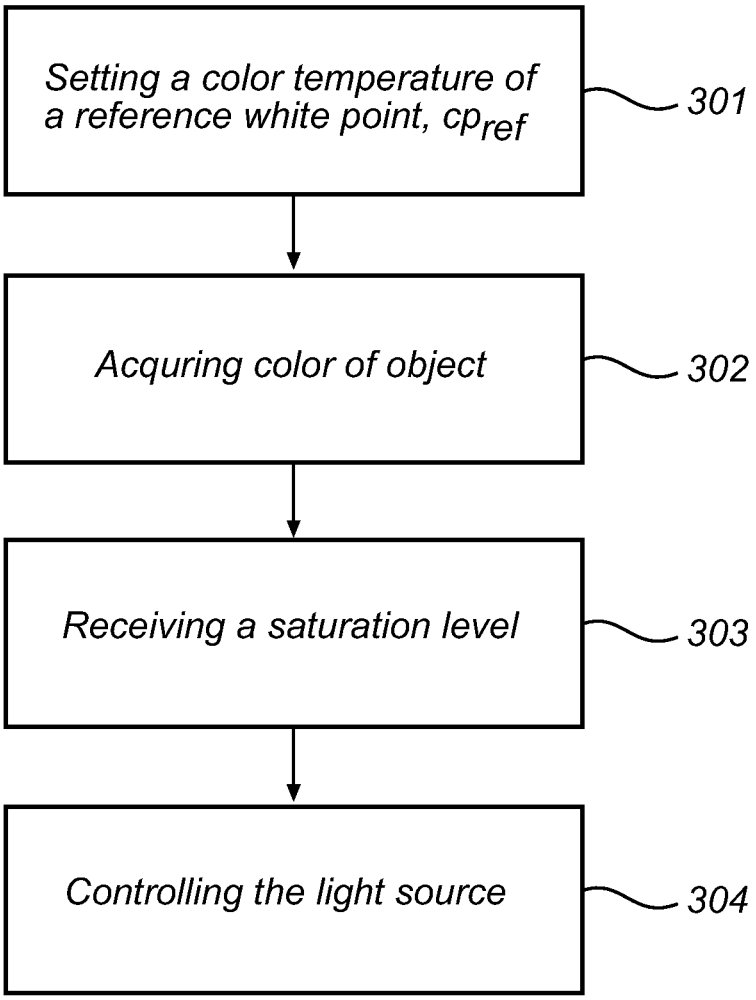
FIG. 3 is a flow chart of the method according to the invention.

In the following operation of the system of FIG. 1 will be described with reference to both FIGS. 2 and 3. FIG. 3 presents exemplifying steps for controlling a color adjustable light source 101.

In a first step, 301, a color temperature of a reference white point $cp_{ref}$ on the black body curve is set to a point somewhere along the black body curve that is available for the RGB spot 101 in question. The setting is here made by a user operating the rotatable knob 106 of the system 100 to a desired white point $cp_{ref}$. Alternatively, the reference white point $cp_{ref}$ may be predetermined, or it may be limited to for example cooler or warmer white light. The desired color temperature may for example differ between countries, areas or even shops. For example, a cooler or warmer white light may be selected as starting-point, depending on the desired effect and/or the general ambient color temperature.

The reference white point $cp_{ref}$ is depicted in the CIE1931 x, y diagram on the black body curve 202.

In a second step, 302, information as to a color of the object $cp_{obj}$ is acquired. Using the system 100 depicted in FIG. 1 the color is measured by means of the color sensor 105 after illuminating the object by means of a reference light source 104. Hence, the reference light source 104 may be set to emit white light with the desired color temperature via the control knob of the user interface 103, and directed toward the object to be illuminated. Here, the color of one of the cans is measured where the can has been moved from the display of cans 111 when performing the measurement. The color may alternatively be measured while the can 110 remains in the display 111. Alternatively, the color sensor may be directed to a certain part of the object, which the user desires to highlight. The color sensor 105 may then acquire the object color by measuring the color that is reflected from the object. For instance, the measurement is here initiated by a user pressing the measurement key 109 of the user interface 103.

In another system arrangement this step may mean color information retrieval from a product identification code, whereby the system comprises a code reader, such as a bar code reader instead of a color sensor.

Alternatively, the retrieved color information may be a rough color classification such as a color selected from the group comprising red, orange, yellow, green, cyan, blue, violet, purple and magenta. As an example, a rough color classification may be retrieved by using a simple color sensor or image sensor (i.e. camera) or by incorporating a color preselect control in the illumination system. However, a rough color classification may equally well be acquired from the aforementioned product identification code.

The object color point $cp_{obj}$ that is measured or otherwise retrieved is in the CIE1931 x, y diagram depicted above the black body curve in the color space. A straight line 206 is depicted between the selected reference white point $cp_{ref}$ and the measured object color point $cp_{obj}$, which line 206 continues to the boundary of the color gamut for the RGB spot 101. The saturation level at the boundary color point $cp_{max}$ is as mentioned 100%. Hence, the available saturation levels for the particular RGB spot 101 are all located on this line 206.

In the next step, 303, a desired saturation level is received. The desired saturation level is here set according to a user selection, by manipulating the user interface slider 107. The level may extend between 0% and 100% color saturation of the color in question, if not restricted differently. In many applications it is preferred to illuminate an object with white light but still highlighting a certain object color. Then, the saturation level may be restricted to the area 205 in the CIE1931 x, y color space 20 where the light is regarded as white. For example, a user control of a user interface may be limited to these levels. Alternatively, in another system arrangement the saturation level may be retrieved from a pre-stored table in relation to a read product identification code.

In the following step, 304, the light source 101 is controlled to illuminate the object with light corresponding to the color temperature of the reference white point $cp_{ref}$ that was set in step 301, but shifted along line 206 in the CIE31 x, y diagram using the saturated component received in step 303 corresponding to the color of the object $cp_{obj}$, acquired in step 302.

The adjusted color point $cp_A$ is depicted in the CIE1931 x, y color space 20, and is here located between the reference white point $cp_{ref}$ and the object color point $cp_{obj}$ on the line 206 extending between these points. Further, in the illustrated example, the adjusted color point $cp_A$ is located in the area 205, wherein the light is considered as white light.

Accordingly, after adjustment of the color adjustable light source 101, it illuminates the can 110 of the present example with white light comprising a saturation component of the measured color point of the object $cp_{obj}$, whereby this color is emphasized and the can 110 is perceived as more conspicuous to a viewer. If the system comprises a control for setting the brightness level, like the system 100 depicted in FIG. 1, also this level is set in step 304 as an additional component, e.g. using the slider 108 in FIG. 1. The brightness level may extend between 0 and 100%, if not restricted differently. All or some of the steps 301-303 may however advantageously be executed in a different order in many systems, with the same outcome.

Figure 4:
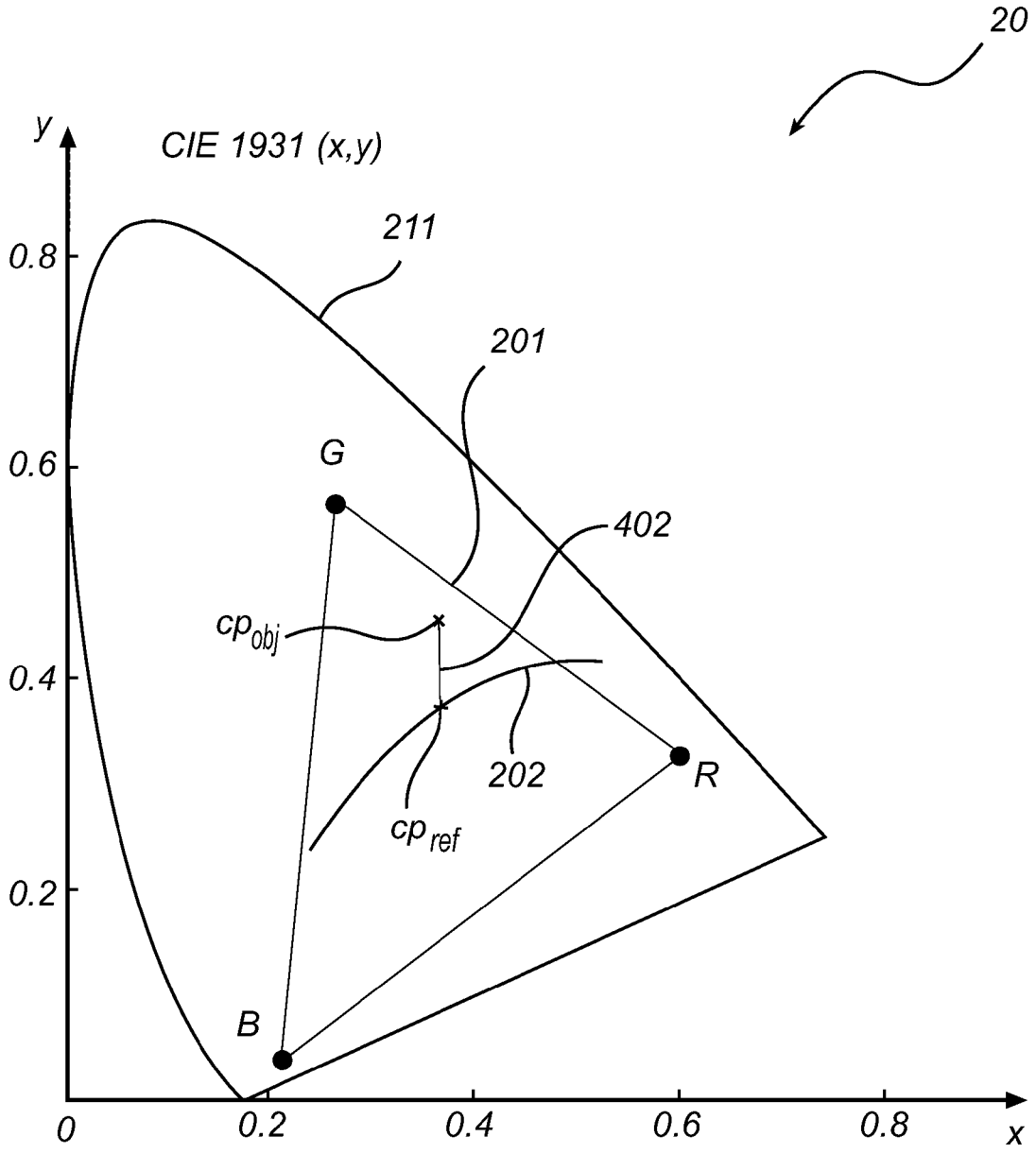
FIG. 4 shows an additional color space chromaticity diagram.

In another exemplary embodiment, the reference white point $cp_{ref}$ is selected so as to have the same color temperature as the object color $cp_{obj}$. Thus, the reference white point $cp_{ref}$ lies on the intersection of a straight line representing constant color temperature 402 starting at $cp_{obj}$ and intersecting the black body curve 202, as illustrated in FIG. 4. For creating different levels of color emphasis while maintaining a constant color temperature, different positions on the straight line 402 can be used.

Even though the invention has been described with reference to specific exemplifying embodiments thereof, many different alterations, modifications and the like will become apparent for those skilled in the art. For example, the saturation level may be retrieved from a table also when the object color is measured by a color sensor, or opposite, the saturation level may be set by a user also when the object color is retrieved by means of a product identification code. Parts of the system may be omitted, interchanged or arranged in various ways, the system yet being able to perform the method of the present invention.

Additionally, variations to the disclosed embodiments can be understood and effected by the skilled person in practicing the claimed invention, from a study of the drawings, the disclosure, and the appended claims. In the claims, the word "comprising" does not exclude other elements or steps, and the indefinite article "a" or "an" does not exclude a plurality. A single processor or other unit may fulfill the functions of several items recited in the claims. The mere fact that certain measures are recited in mutually different dependent claims does not indicate that a combination of these measured cannot be used to advantage.

The invention claimed is:

1. A method for controlling a color adjustable light source configured to illuminate an object, comprising the steps of:

setting a color temperature of a reference white point ($cp_{ref}$) adjacent to the black body curve;

acquiring information as to a color of said object ($cp_{obj}$);

receiving a desired saturation level; and controlling the light source to illuminate said object with light corresponding to the color temperature of the reference white point ($cp_{ref}$) and comprising a saturated component corresponding to the color of the object ($cp_{obj}$).

2. The method according to claim 1, further comprising the step of controlling the spectral power distribution of the color adjustable light source for a given reference white point ($cp_{ref}$), object color ($cp_{obj}$) and saturation level.

3. The method according to claim 1, wherein the step of acquiring information as to a color of said object ($cp_{obj}$) comprises the steps of:

illuminating said object with light having said color temperature of the reference white point ($cp_{ref}$), such that the color of the object ($cp_{obj}$) is reflected; and measuring said color of the object ($cp_{obj}$) by means of a color sensor.

4. The method according to claim 1, wherein the step of acquiring information as to a color of said object ($cp_{obj}$) comprises the steps of:

reading an object identification code for said object; and retrieving a color corresponding to said object identification code.

5. The method according to claim 4, wherein the step of receiving a desired saturation level comprises the step of retrieving a pre-stored saturation level corresponding to said object identification code.

6. The method according to claim 1, wherein the step of acquiring information as to a color of said object ($cp_{obj}$) comprises the step of acquiring an approximate color classification.

7. The method according to claim 1, wherein said saturation level is limited to a predefined area surrounding the black body curve.

8. A system for controlling a color adjustable light source, the system comprising:

a light source configured to illuminate an object; and a control unit configured to set a color temperature of a reference white point ($cp_{ref}$) adjacent to the black body curve; acquire information as to a color of said object ($cp_{obj}$); receive a desired saturation level; and control the light source to illuminate said object with light corresponding to the color temperature of the reference white point ($cp_{ref}$) and comprising a saturated component corresponding to the color of the object ($cp_{obj}$).

9. The system according to claim 8, further comprising:

a reference light source configured to illuminate said object with light having said color temperature of the reference white point ($cp_{ref}$), such that the color of the object is reflected; and a color sensor configured to measure said color of the object ($cp_{obj}$).

10. The system according to claim 8, further comprising:

a sensor arranged in proximity of the illuminated object and configured to measure the ambient light, said sensor being communicatively coupled to said control unit.

11. The system according to claim 9, wherein said light source configured to illuminate the object is said reference light source.

12. The system according to claim 9 further comprising a remote control on which said reference light source and said color sensor is arranged.

13. The system according to claim 8, further comprising a code reader configured to read an object identification code for said object, and retrieve the color corresponding to said object identification code.

14. The system according to claim 13, further comprising a remote control comprising said code reader.

15. The system according to claim 13 wherein said code reader is at least one of an RFID and bar code reader.

* * * * *